United States Patent [19]

Petrosky

[11] 4,304,067

[45] Dec. 8, 1981

[54] HOOP APPARATUS

[76] Inventor: Charles Petrosky, 1118 N. Jefferson St., Arlington, Va. 22205

[21] Appl. No.: 966,711

[22] Filed: Dec. 5, 1978

[51] Int. Cl.[3] ..... A63H 33/02

[52] U.S. Cl. ..... 46/220

[58] Field of Search ..... 46/220, 114, 47

[56] References Cited

U.S. PATENT DOCUMENTS

| | | | |
|---|---|---|---|
| 464,151 | 12/1891 | Doublier | 46/114 |
| 2,984,937 | 5/1961 | Rendon | 46/220 |
| 3,494,069 | 2/1970 | Klimko | 46/220 |
| 4,021,963 | 5/1977 | Kingswell | 46/220 |
| 4,030,242 | 6/1977 | Sintron | 46/220 |

FOREIGN PATENT DOCUMENTS

| | | | |
|---|---|---|---|
| 978360 | 11/1975 | Canada | 46/220 |

*Primary Examiner*—Gene Mancene
*Assistant Examiner*—Mickey Yu
*Attorney, Agent, or Firm*—James C. Wray

[57] ABSTRACT

A hollow inner hoop receives a fluent material through a filler valve and fits within a curved inward facing depression in an outer hoop. The outer hoop has a slot in its outer surface; a stick with guiding wings at a proximal end fits within the slot and is turned to align the guiding wings within an axial direction of the hoops.

6 Claims, 4 Drawing Figures

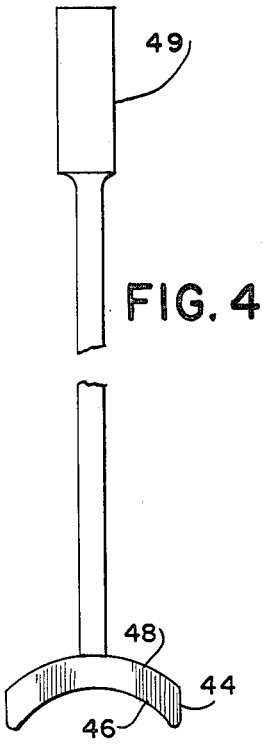
FIG. 4
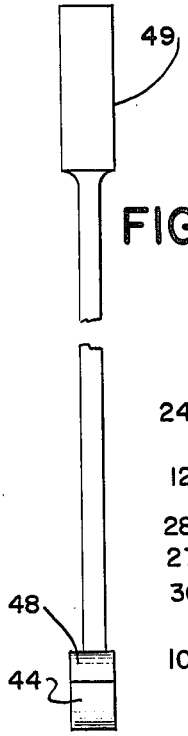
FIG. 3
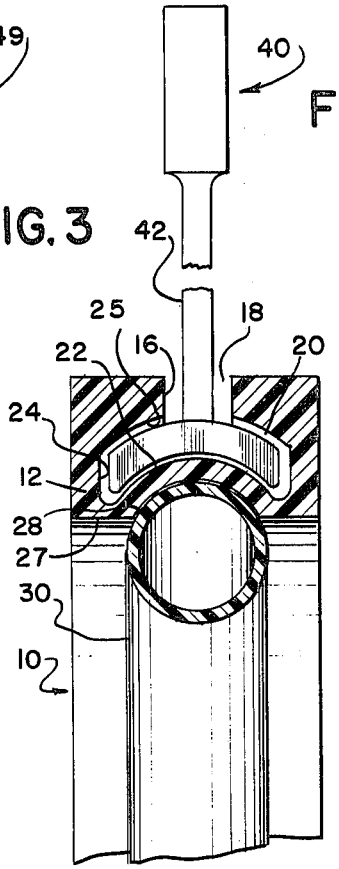
FIG. 1
FIG. 2
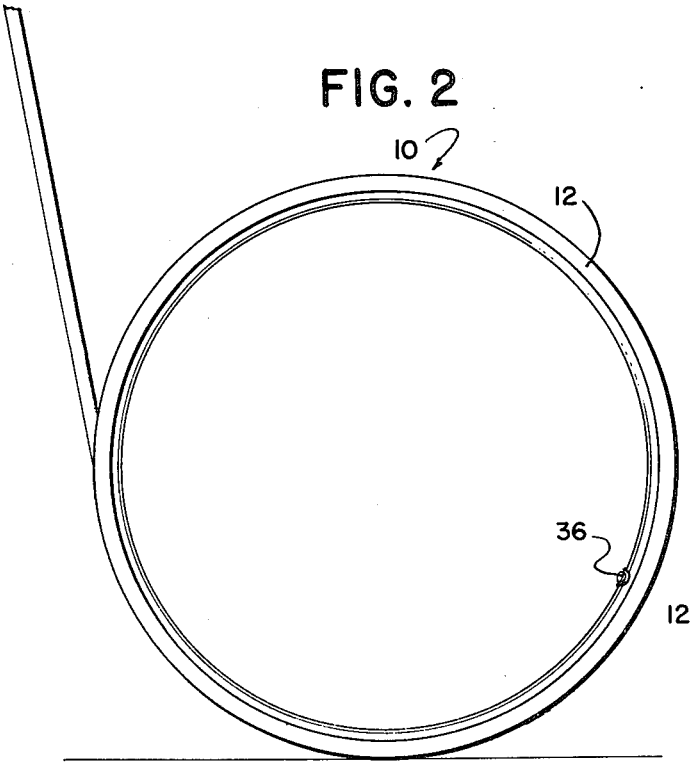
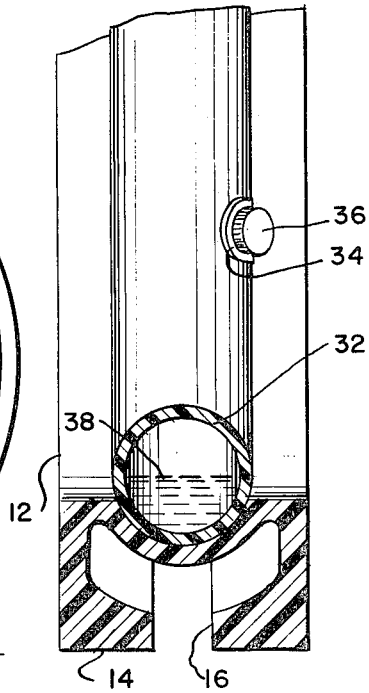

HOOP APPARATUS

BACKGROUND OF THE INVENTION

Hoops of the type of the present invention are found in Class 46, subclass 220, in the Official Classifications of the U.S. Patent and Trademark Office.

Examples of prior art hoop patents are:

U.S. Pat. Nos.

2,811,812
3,049,833
3,715,834
4,021,963.

Heretofore, no hoop apparatus has had a guiding stick which may be readily attached and detached from the hoop but which may not become unintentionally detached in use.

No hoop apparatus has been known which can employ a guiding stick within an interior of a hoop while still providing a hollow space for fluent material. No hoop apparatus provides a firmly attached guiding stick while also providing varied weight, uniform rolling speed, stability, and braking effects.

No hoop apparatus is known in which multiple hoops may be readily attached together.

SUMMARY OF THE INVENTION

The present invention has a hoop with a filler valve to admit fluent material within a hollow portion of the hoop body.

The hoop of the present invention has a slot in an outer surface which communicates with a hollow inner portion. A guide stick has a proximal end which extends through the slot, and guide wings attached to the proximal end of the stick fit within the open hollow portion and extend in a generally axial direction to firmly engage the hoop.

The inner surfaces of the guiding wings of the stick are curved at a radius commensurate with a major radius of the hoop, so that the guiding wings may be aligned transverse to an axial direction to remove the stick from the slot.

In one form of the invention, the hoop has two hollow chambers. One is provided with a filler valve for receiving fluent material. The other hollow chamber communicates with an exterior of the hoop through a slot for receiving a guiding stick.

An object of this invention is to provide a hoop having uniform rolling and rolling resistance and having a guiding stick locked against unintentional disassembly yet sliding easily in relation to the hoop during use and readily contacting and controlling the hoop.

Objects of the invention are provided by a hoop having a hollow body, which has a radially outward facing surface and a central slot in the surface for communicating a hollow center of the hoop with an exterior of the hoop through the slot, and wherein the hollow center has portions which extend axially outward from the slot.

A control stick has a shaft with a proximal end positioned in the slot and guiding wings extending laterally from the proximal end in an axial direction of the hoop. The shaft has a distal end with a handle.

In a preferred form, a radially inward edge of the guiding wings is curved to follow a major curvature of the hoop, whereby the wings may be aligned transversely to an axial direction for removing the wings through the slot.

Objects of the invention are accomplished by providing a rolling hoop with a filler valve and plug and a fluent material partially filling the hoop.

In a preferred form the hoop apparatus includes an inner hoop portion having a hollow closed body, and means to fill the body with a fluent material and an outer hoop portion having a hollow body.

Preferably the outer hoop has a radially inward facing configuration for receiving and holding the inner hoop. In a preferred embodiment the radially inward facing configuration is a curvilinear depression formed in an inward facing surface of the outer hoop.

These and other and further objects and features of the invention are apparent in the disclosure which includes the above and ongoing description and the claims and the drawings.

BRIEF DESCRIPTION OF THE DRAWINGS

FIG. 1 is a cross-sectional foreshortened detail of the hoop apparatus of the present invention.

FIG. 2 is a side elevational detail showing the hoop in use.

FIG. 3 and FIG. 4 are elevations of the guiding stick.

DETAILED DESCRIPTION OF THE DRAWINGS

Referring to FIGS. 1 and 2, a hoop apparatus is generally referred to by the numeral 1. An outer hoop 10 has a generally rectangular cross section, with relatively straight lateral walls 12 and a relatively flat outer wall 14. The outer wall 14 has inward facing walls 16 which form a slot 18 leading to a hollow opening 20.

The hollow opening 20 in the outer hoop 10 has a curved inner wall 22, relatively flat side walls 24, and outer walls 25.

The inner walls 22 and the outer walls 25 of the cavity 20 are exagerated in the drawings and are formed with transverse curvatures commensurate with an average major curvature of the hoop. Thus forming the cavity 20 enables a guiding stick to be aligned transverse to an axial direction of the hoop for easy assembly and disassembly, while providing close contact, while the guiding stick is aligned in an axial direction in its operational position as shown in FIG. 1.

An inward facing surface 27 of the outer hoop 10 has a central curved depression 28 for receiving a similarly curved outer wall 32 of an inner hoop 30.

The inner hoop 30 has a valve 34 and a plug 36 for receiving a fluent material 38 which may fill a desired lower portion of the inner hoop 30.

The fluent material may be water or viscous liquid or may be a finely divided solid material such as sand, or a combination of both.

The hoop is controlled by a stick 40 which has an elongated shaft 42 with oppositely extending guiding wings 44 at a distal end. An inner edge 46 of the guiding wings is curved as shown in FIGS. 3 and 4 to match a curvature of the inner surface 22 of the outer hollow portion.

The outer surface 48 of the guiding wings 44 may be curved to match correspondingly curved inward facing surfaces 25 of the cavity 20.

In use, the stick is turned so that the guiding wings are aligned transversely to an axis of the hoop and the guiding wings are inserted in the slot and turned in the cavity 20 to lock the wings in the cavity. The hoop is rolled to the right in a clockwise direction as shown in FIG. 2 by forward urging of the stick in the position shown in that figure.

The fluent material in the inner hoop tends to stabilize and brake and maintain uniform velocity of the hoop. As a jogger pushes the hoop, the pushing action tends to exercise parts of his body while the braking and uniform angular velocity of the hoop tend to standardize the speed of the runner in a desirable manner.

While the invention has been described with reference to specific embodiments, it will be obvious to those skilled in the art that modifications and variations of the invention can be made without departing from the scope of the invention. The scope of the invention is defined in the following claim.

I claim:

1. The hoop apparatus comprising an inner hoop having a hollow closed body with a curved outer wall and valve and plug means extending through the curved outer wall of the hollow closed body to partially fill a desired lower portion of the body with a fluent material for tending to stabilize and brake and maintain uniform angular velocity of the hoop apparatus, and an outer hoop having a hollow body and having a radially inward facing configuration for receiving and holding the inner hoop.

2. The hoop apparatus of claim 1 wherein the radially inward facing configuration comprises a curvilinear depression formed in an inward facing surface of the outer hoop.

3. The hoop apparatus of claim 1 wherein the outer hoop has a radially outward facing surface and further comprising a central slot in the surface for communicating a hollow center of the outer hoop with an exterior of the outer hoop through the slot.

4. The hoop apparatus of claim 3 wherein the hollow center has portions which extend axially outward from the slot and further comprising a stick having a shaft with a proximal end positioned in the slot and guiding wings extending laterally from the proximal end in an axial direction of the hoop and the shaft having a distal end with a handle attached thereto.

5. The hoop apparatus of claim 4 wherein a radially inward edge of the guiding wings is curved to follow a curvature of the hoop, whereby the wings may be aligned transversely to an axial direction for removing the wings through the slot.

6. The hoop apparatus comprising a hoop having a hollow body, which has a radially outward facing surface and a central slot in the surface for communicating a hollow center of the hoop with an exterior of the hoop through the slot and wherein the hollow center has portions which extend axially outward from the slot, further comprising a stick having a shaft with a proximal end positioned in the slot and guiding wings extending laterally from the proximal end in an axial direction of the hoop and the shaft having a distal end with a handle attached thereto, wherein a radially inward edge of the guiding wings is curved to follow a curvature of the hoop, whereby the wings may be aligned transversely to an axial direction for removing the wings through the slot.

* * * * *